United States Patent [19]

Monkelbaan et al.

[11] Patent Number: 4,796,051

[45] Date of Patent: Jan. 3, 1989

[54] MULTICOLOR LIQUID INK DEVELOPMENT SYSTEM

[75] Inventors: Edwin R. Monkelbaan, Fairport; Joseph Fantuzzo, Webster, both of N.Y.

[73] Assignee: Xerox Corporation, Stamford, Conn.

[21] Appl. No.: 26,423

[22] Filed: Mar. 16, 1987

[51] Int. Cl.[4] ..... G03G 15/10

[52] U.S. Cl. ..... 355/4; 355/10; 355/14 D; 118/645; 118/647

[58] Field of Search ..... 355/3 R, 3 DD, 4, 14 D, 355/10–11; 118/645, 647, 652

[56] References Cited

U.S. PATENT DOCUMENTS

Re. 28,568 10/1975 Saito et al. ..... 355/10 X 4,640,605 2/1987 Ariyama et al. ..... 355/4

*Primary Examiner*—A. C. Prescott

*Assistant Examiner*—Jane Lau

*Attorney, Agent, or Firm*—H. Fleischer; J. E. Beck; R. Zibelli

[57] ABSTRACT

An apparatus in which latent images are developed with a liquid developer material of selected colors. A plurality of stationarily mounted developer units have liquid developer materials of selected colors supplied thereto. A cleaning material is furnished to clean the liquid developer material from the first developer unit having the liquid developer material supplied thereto prior to the second developer unit having the liquid developer material supplied thereto so as to prevent comingling of different color developer materials during development of the next latent image.

1 Claim, 2 Drawing Sheets

MULTICOLOR LIQUID INK DEVELOPMENT SYSTEM

Figure 1:
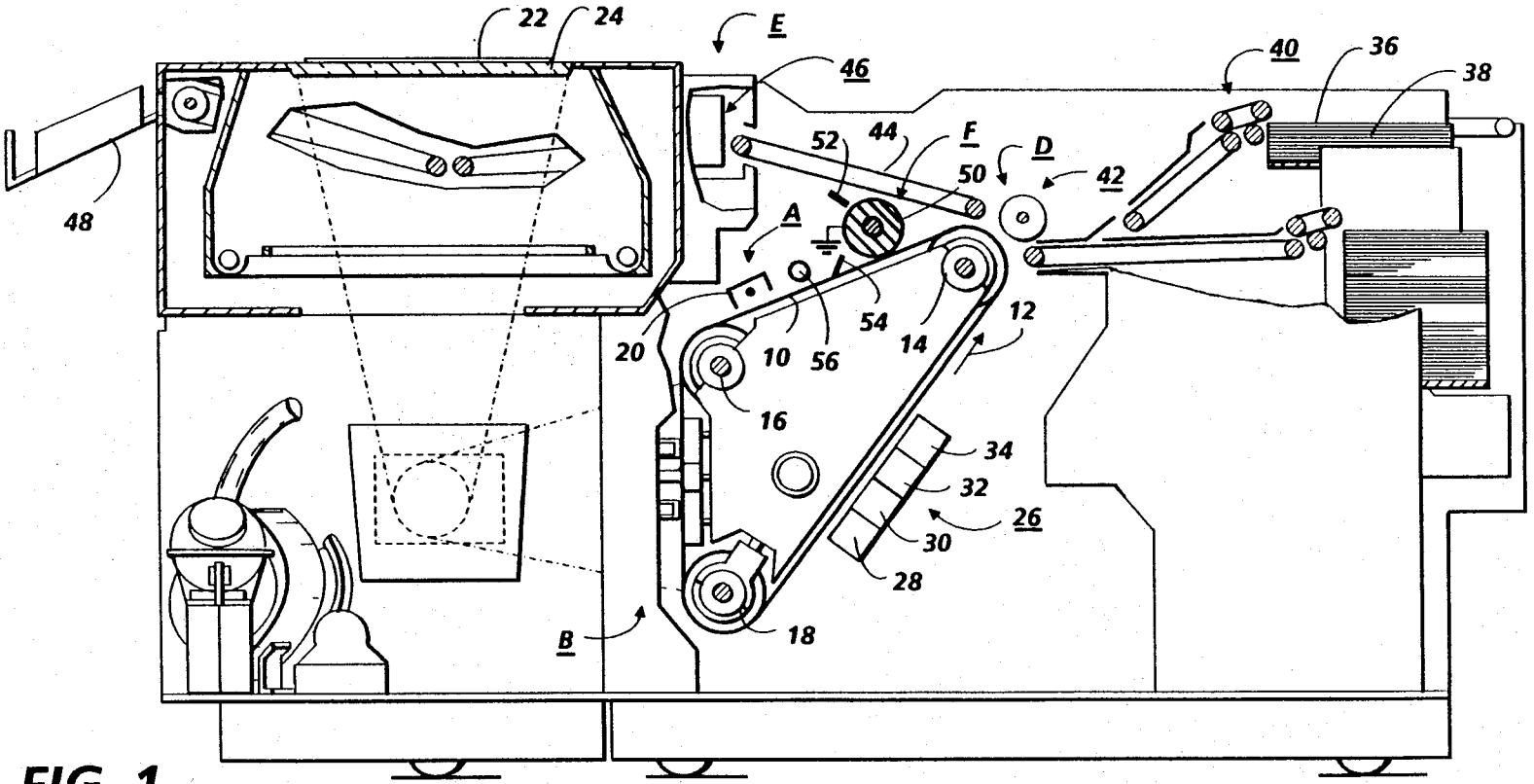

This invention relates generally to an electrophotographic printing machine, and more particularly concerns an apparatus for developing an electrostatic latent image to form multicolor copies.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles dispersed therein. The pigmented particles are deposited, in image configuration, on the photoconductive member. Thereafter, the developed image is transferred to the copy sheet. Heat is applied to the copy sheet to permanently fuse the pigmented particles to the copy sheet and vaporize the residual liquid carrier adhering thereto. In forming a multicolor copy, successive latent images are recorded on the photoconductive surface. Each latent image is optically filtered. These latent images are developed with developer material having a color corresponding to the subtractive primary of the color of the optical filter. The differently colored developed images are transferred from the photoconductive surface to the copy sheet in superimposed registration with one another. Thereafter, heat is applied to permanently fuse the image to the copy sheet so as to form a multicolor copy.

Hereinbefore, multicolor development systems requird at least three developer units. Each developer unit contained a different color developer material. Generally, one of the developer units was positioned closely adjacent the photoconductive surface with the remaining developer units being spaced therefrom. In this way, the latent image was developed by the developer material contained within the developer unit positioned closely adjacent the photoconductive surface. The remaining developer units were inoperative so as to prevent comingling of differently colored developer material on the same latent image. For example, the Hitachi color copier, Model No. GX-201 employed four, independent, identical developer assemblies, one for each color developer material. For each copy cycle developer material is circulated from the sump through a developer tray where the copy is developed. The four developer trays are mounted to form a single unit. The assembly is movable in both the horizontal and vertical directions. The copy paper is stationary and tray assembly moves left and right for each color. The proper developer tray is selected by moving the assembly vertically to register the tray to a belt drive. The tray then moves in the horizontal direction to effect development of the copy sheet. At the completion of the cycle, the liquid drains back into the sump. It has been found that mechanical movement of the developer units produces vibration. This vibration degrades copy quality. Hence, it is desirable to prevent comingling of differently colored developer materials without inducing vibrations in the printing machine.. The following disclosures appear to be relevant:

U.S. Pat. No. 3,900,003. Patentee: Sato et al. Issued: Aug. 19, 1975.

U.S. Pat. No. 3,910,231. Patentee: Inoue et al. Issued: Oct. 7, 1975.

U.S. Pat. No. 4,350,429. Patentee: Slavin Issued: Sept. 21, 1982.

U.S. Pat. No. 4,358,195. Patentee: Kuehnle et al. Issued: Nov. 9, 1982.

U.S. Pat. No. 4,421,056. Patentee: Schinke. Issued: Dec. 20, 1983.

U.S. Pat. No. 4,449,475. Patentee: Schinke. Issued: May 22, 1984.

U.S. Pat. No. 4,456,367. Patentee: Szymanski et al. Issued: June 26, 1984.

U.S. Pat. No. 4,504,137. Patentee: Aoki et al. Issued: Mar. 12, 1985.

U.S. Pat. No. 4,580,889 Patentee: Hiranuma et al. Issued: Apr. 8, 1986.

U.S. Pat. No. 4,627,705. Patentee: Landa et al. Issued: Dec. 9, 1986.

The relevant portions of the foregoing disclosures may be briefly summarized as follows:

Sato et al. discloses a liquid developing device for use in a multicolor electrophotographic copying machine. Latent images are developed at a common developing electrode and a developing solution of a designated color is supplied through feed pipes. Control of the desired color is maintained through celluloid valves provided for each of the feed pipes.

Inoue et al. describes a developing device for a polychromic electrophotographic copier containing a developer supply means for supplying developer of a predetermined color to a single developing station. Developer storage tanks are provided for containing the desired colors. The developer is transferred through supply pipes and controlled by a valving system provided with each of the supply pipes.

Slavin discloses a material processing system for selectively utilizing material contained in respective storage tanks. A pump and a selector valve is provided for delivering desired fluids to operations throughout the system.

Kuehnle et al. describes an electrophotographic color proofing apparatus. A toning assembly is provided which contains four separate toning canisters. A vacuum nozzle is associated with each canister for removing excess toner from the photoconductive member after development.

Schinke U.S. Pat. No. 4,421,056 discloses a nozzle arrangement for applying colored liquids to an intermediate image carrier of an electrophoretic printer. A nozzle is provided for each colored liquid whereby the nozzles are arranged one over another to form a toner unit. A separate nozzle containing a cleaning fluid is arranged at the other side of the intermediate image carrier.

Schinke U.S. Pat. No. 4,449,475 describes a cleaning device for removing toner suspensions of different colors from an intermediate image carrier. Air is forced through the system to ensure that each colored toner suspension flows over a ruler shaped upper edge of an air duct to an appropriately colored collecting reservoir.

Szymanski et al. discloses a liquid toning system for an electrophotographic imaging apparatus. A plurality of toner modules containing multiple colors are provided whereby a desired color module is elevated above the remaining modules for toning. Each module contains a supply system allowing the toner to be delivered from a reservoir bottle to an exposed photoconductive surface by a toggle activated control valve which directs the toner flow.

Aoki et al. describes an electrophotographic printing machine for forming color images. Development of a latent image is carried out at a developing station having four developing units for feeding the necessary color developers.

Hiranuma et al. discloses a multicolor image reproduction appratus. A plurality of photoconductive drums have individual developer units associated therewith. The photoconductive drums are positioned around the outer circumference of a transfer drum. The developed images are transferred from the conductive drums to the copy paper adhering to the transfer drum.

Landa et al. describes a multicolor electrophotographic printing machine in which development of each color occurs at a common station positioned about the periphery of the photoconductive drum. A distribution system pumps the desired colored liquid to the development housing and returns the liquid to its original supply bottle. A supply of cleaning fluid is also utilized for flushing the common portion of the circulating system before and after a change of color.

In accordance with one aspect of the present invention, there is provided an apparatus arranged to develop latent images with a selected one of a plurality of differently colored liquid developer materials. The apparatus includes a plurality of stationarily mounted developer units. Means supply liquid developer materials of selected colors to each one of the developer units. The supplying means supplies liquid developer material of a selected color to a first developer unit so as to develop the latent image with the liquid developer material of the selected color. Means furnish a cleaning material to the first developer unit so as to clean the liquid developer material therefrom prior to the supplying means supplying liquid developer material of another color to a second developer unit so as to prevent comingling of different color developer materials during development of another latent image.

Pursuant to another aspect of the features of the present invention, there is provided an electrophotographic printing machine of the type having an electrostatic latent image recorded on a photoconductive member. The printing machine includes a plurality of stationarily mounted developer units. Means supply liquid developer materials of selected colors to each one of the developer units. The supplying means supplies liquid developer material of a selected color to a first developer unit so as to develop the latent image with the liquid developer material of the selected color. Means furnish a cleaning material therefrom prior to the supplying means supplying liquid developer material of another color to a second developer unit so as to prevent comingling of different color developer materials during development of another latent image.

Figure 2:
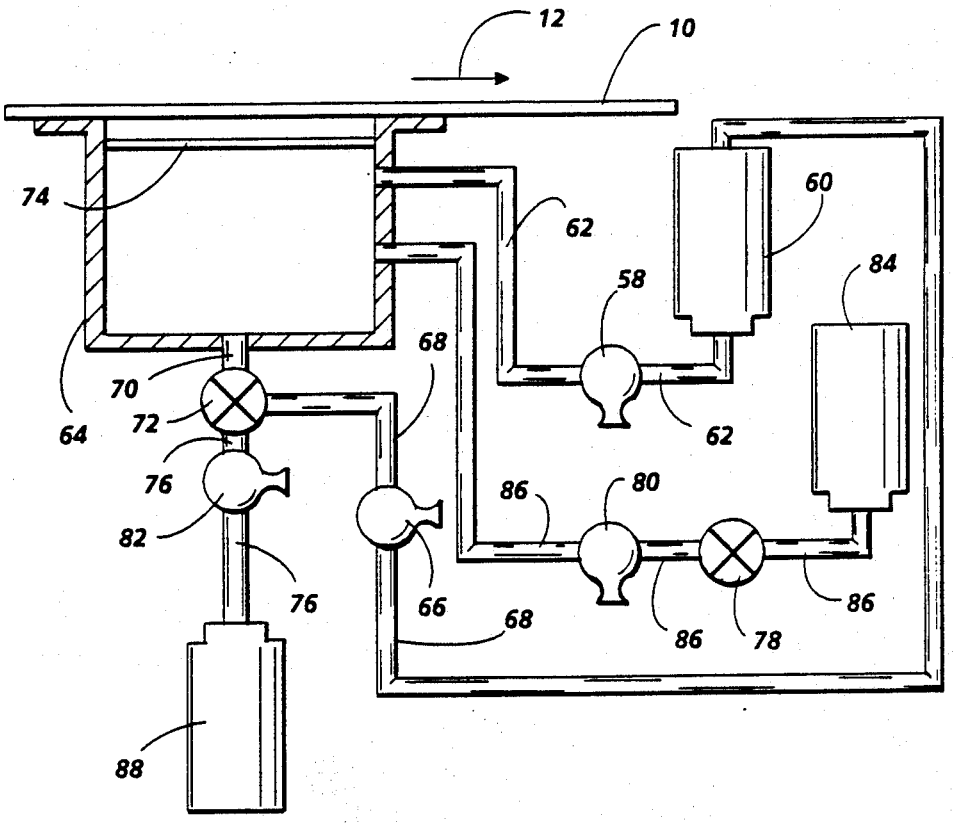

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is an elevational view depicting one developer unit used in the FIG. 1 printing machine.

While the present invention will hereinafter be described in conjunction with a preferred embodiment thereof, it will be understood that it is not intended to limit the invention to this embodiment. On the contrary, it is intended to cover all alternatives, modifications, and equivalents as may be included within the spirit and scope of the invention as defined by the appended claims.

Inasmuch as the art of the electrophotographic printing is well known, the various processing stations employed in the FIG. 1 printing machine will be shown hereinafter schematically and their operation descried briefly with reference thereto.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16 and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through an optical filter and a lens forming a color filtered light image thereof. The lens focuses the color filtered light image onto the charged portion of the photoconductive surface to selectively dissipate the charge thereon. This records a single color electrostatic latent image on the photoconductive surface corresponding to the informational areas contained within one color of the original document. When a multicolor original document is being reproduced, successive single color light images are formed by transmitting light image through a red optical filter, a green optical filter, and a blue optical filter. In the event a black copy is to be formed, the light image is transmitted through a neutral density optical filter. In this manner, a red filtered electrostatic latent image, a green filtered electrostatic latent image and a blue filtered electrostatic latent image are recorded on the photoconductive surface. If the copy is to be in black, a neutral density filtered electrostatic latent image is recorded on the photoconductive surface. Thereafter, belt 10 advances the color filtered electrostatic latent images recorded on photoconductive surface 12 to development station C.

At development station C, a developing liquid comprising a clear insulating carrier liquid and colored toner particles, contacts the electrostatic latent image. A development apparatus, indicated generally by the reference numeral 26, includes four developer units 28, 30, 32, and 34 mounted stationarily on the printing machine frame. Each developer unit is identical to one another. The only distinction between developer units is the color of the developer material contained therein. Developer unit 28 has clear carrier and cyan colored toner. Developer unit 30 contains clear carrier and magenta colored toner. Developer unit 32 has clear carried and yellow colored toner. Developer unit 34 contains clear carrier and black toner. Developer unit 28 is energized to develop the red filtered latent image recorded on the photoconductive surface with cyan colored developer. Developer unit 30 is energized to develop the green filtered latent image recorded on the photoconductive surface with magenta colored developer. Developer unit 32 is energized to develop the blue filtered latent image recorded on the photoconductive surface with yellow colored developer. Developer unit 34 is energized to develop the neutral density filtered latent image recorded on the photoconductive surface with black colored developer. After each developer unit develops the appropriate latent image and before the next developer unit is energized to develop the next latent image, the developer unit that has been energized is cleaned to purge liquid developer material therefrom. A cleaning fluid is circulated through the developer unit before energizing the next developer unit. Preferably, the cleaning fluid is the clear fluid carrier. In operation, the red filtered latent image is developed with cyan colored developer material by developer unit 28. Cleaning material is then circulated through developer unit 28 to purge the developer material therefrom. Thereafter, developer unit 30 is energized to develop the green filtered latent image with magenta developer material. After development of the green filtered latent image, the cleaning fluid is circulated through developer unit 30 to purge the magenta developer material therefrom. Next, developer unit 32 is energized to develop the blue filtered latent image with yellow developer material. After the blue filtered latent image has been developed with yellow developer material, cleaning material is circulated through developer unit 32 to purge the developer material therefrom. In the event a black copy is being reproduced, the neutral density filtered latent image is developed by energizing developer unit 34 which develops the neutral density latent image with black developer material. After the neutral density latent image is developed, cleaning fluid is circulated through developer unit 34 to purge the residual liquid developer material therefrom. Developer units 28, 30, 32 and 34 are mounted stationarily in the printing machine so as to reduce vibration and improve copy quality.

After development, belt 10 advances the developed image to transfer station D. At transfer station D, a sheet of support material 36, i.e. a copy sheet, is advanced from stack 38 by a sheet feeder, indicated generally by the reference numeral 40. The sheet of support material is advanced to an electrically biased transfer roller, indicated generally by the reference numeral 42, located at transfer station D. The sheet of support material is secured releasably to transfer roller 42 so as to rotate therewith. In this way, successive liquid images are transferred electrostatically to the sheet of support material in superimposed registration with one another. In forming a multicolor copy, the cyan developed image, the magenta developed image and the yellow developed image are transferred to the copy sheet in superimposed registration with one another. This forms the multicolor copy. If a black copy is being formed, the copy sheet adheres to transfer roller 42 for only one pass so as to transfer the black developed image thereto. After transfer, the copy sheet continues to move onto conveyor 44 which advances the sheet to fusing station E.

Fusing station E includes a fusing system indicated generally by the reference 46. The fuser assembly vaporizes the liquid carrier from the copy sheet and permanently fuses the toner particles in image configuration thereto. This forms a multicolor copy. After fusing, the copy sheet is advanced to catch tray 48 for subsequent removal from the printing machine by the operator.

After transfer, some residual liquid developer material remains adhering to the photoconductive surface. This residual developer material is removed from the photoconductive surface at cleaning station F. Cleaning station F includes a cleaning roller 50, formed of any appropriate synthetic resin driven in a direction opposite to the direction of movement of the photoconductive surface to scrub the photoconductive surface clean. To assist in this action, developing liquid may be fed through pipe 52 onto the surface of cleaning roller 50. A wiper blade 54 completes the cleaning of the photoconductive surface. Any residual charge left on the photoconductive surface is extinguished by flooding the photoconductive surface with light from lamp 56.

Preferably, the developer material includes a clear liquid insulating carrier having pigmented particles, i.e. toner particles dispersed therein. A suitable clear insulating liquid carrier may be made from aliphatic hydrocarbon, such as an Isopar, which is a trademark of the Exxon Corporation, having a low boiling point. The toner particles include a pigment associated with a polymer. A suitable liquid developer material is described in U.S. Pat. No. 4,582,774, issued to Landa in 1986, the relevant portions thereof being incorporated into the present application.

It is believed that the foregoing description is sufficient for purposes of the present application to illustrate the general operation of an electrophotographic printing machine incorporating the features of the present invention therein.

Referring now to FIG. 2, there is shown developer unit 28 in greater detail. Each developer unit of development apparatus 26 is mounted stationarily in the printing machine and identical with the only distinction between developer units being the color of the developer material contained therein. A developing liquid comprising a clear insulating carrier liquid and cyan colored toner particles, is circulated by pump 58 from container 60 through pipe 62 into development tray 64 from which it is withdrawn by pump 66 through pipe 68 for recirculation. Tray 64 is mounted fixedly on the frame of the printing machine and does not move. Suitable means such as bolts may be employed to secure stationarily tray 64 to the printing machine frame. When liquid developer material is being circulated, valve 72 connects pipe 70 to pipe 68. Development electrode 74, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction ofmovement of the photoconductive surface, is spaced from the photoconductive surface and adapted to shear excessive liquid from the developed image without disturbing the image.

With continued reference to FIG. 2, after the red filtered latent image has been developed by developer unit 28 and prior to energization of any of the other developer units of development apparatus 26, cleaning fluid is flushed through tray 64 to purge the liquid developer material therefrom. This also cleans liquid developer material form development electrode 74 and the roller. During the cleaning mode of operation, pumps 58 and 66 are de-energized and valve 68 couples pipe 76 to pipe 70. Valve 78 is opened and pumps 80 and 82 energized. In this way cleaning fluid from container 84 is pumped through pipe 86 into tray 64 to purge the residual liquid developer material therefrom. Residual liquid developer is also removed from development electrode 74 and the roller. Pump 82 removes the cleaning fluid and residual liquid developer material from developer unit 28. The residual developer material and cleaning fluid is transported through pipe 70 into pipe 76 which is connected to container 88 for subsequent removal from the printing machine. Preferably, the cleaning fluid is the carrier of the liquid developer material, i.e. a clear low boiling point aliphatic hydrocarbon, such as an Isopar, which is a trademark of the Exxon Corporation.

In recapitulation, it is clear that the development apparatus of the present invention employs a plurality of stationary developer units. Each unit is adapted to develop a single color latent image with a developer material complimentary in color to the color of the optically filtered light image. The first developer unit is cleaned by purging the residual developer material contained therein with a cleaning fluid prior to energization of the next developer unit. A system of this type reduces vibration while preventing comingling of different color developer materials.

It is, therefore, evident that there has been provided in accordance with the present invention, a development apparatus that fully satisfies the aims and advantages heretofore mentioned. While this invention has been described in conjunction with a preferred embodiment, it is evident that many alternatives, modifications and variations will be apparent to those skilled in the art. Accordingly, it is intended to embrace all such alternatives, modifications and variations that fall within the spirit and broad scope of the appended claims.

We claim:

1. An electrophotographic printing machine of the type having an electrostatic latent image recorded on a photoconductive member, wherein the improvement includes:

a plurality of stationarily mounted developer units;

means for supplying a liquid developer material of a selected color to each one of said plurality of said developer units, said supplying means supplying liquid developer material of a selected color to one of said plurality of developer units so as to develop the electrostatic latent image recorded on the photoconductive member with the liquid developer material of the selected color with the liquid developer material comprising at least a substantially colorless carrier having toner particles selected from cyan, magenta, yellow or black pigments therein; and means for furnishing a cleaning material including at least the colorless carrier of the developer material to said one of said plurality of developer units so as to clean the liquid developer material therefrom prior to said supplying means supplying liquid developer material of another color to a other one of said plurality of developer units to prevent comingling of different color developer materials during development of another electrostatic latent image recorded on the photoconductive member, said furnishing means being de-energized prior to said supplying means supplying liquid developer material to said other one of said plurality of developer units.

* * * * *